US009731952B2

(12) United States Patent
Müller

(10) Patent No.: US 9,731,952 B2
(45) Date of Patent: Aug. 15, 2017

(54) AMPULE BREAKING AID

(75) Inventor: Frank Müller, Feldkirch (AT)

(73) Assignee: Ivoclar Vivadent AG, Schaan (LI)

( * ) Notice: Subject to any disclaimer, the term of this patent is extended or adjusted under 35 U.S.C. 154(b) by 13 days.

(21) Appl. No.: 12/791,045

(22) Filed: Jun. 1, 2010

(65) Prior Publication Data

US 2010/0301089 A1 Dec. 2, 2010

(30) Foreign Application Priority Data

May 29, 2009 (EP) ..... 09 161 599

(51) Int. Cl.
*B26F 3/00* (2006.01)
*B67B 7/92* (2006.01)

(52) U.S. Cl.
CPC ..... *B67B 7/92* (2013.01); *Y10T 225/371* (2015.04)

(58) Field of Classification Search
CPC ..... B67B 7/92; Y10T 225/371
USPC ..... 225/103, 96.5, 93; 30/1.5; 241/99; 215/47
See application file for complete search history.

(56) References Cited

U.S. PATENT DOCUMENTS 2,359,644 A * 10/1944 Hoey ..... 451/558
2,865,524 A 12/1958 Reznek
2,977,014 A 3/1961 Kock
3,459,185 A * 8/1969 Bender et al. ..... 604/404
3,506,006 A * 4/1970 Lange, Jr. ..... 604/190
3,552,083 A * 1/1971 Andersen et al. ..... 53/468
3,720,250 A * 3/1973 Goldberg et al. ..... 81/3.4
3,720,341 A * 3/1973 Greenfield et al. ..... 215/6
4,353,869 A * 10/1982 Guth ..... 422/558
4,506,817 A * 3/1985 Parker ..... 225/96.5
4,779,763 A * 10/1988 Klawitter ..... 222/80
4,826,025 A * 5/1989 Abiko et al. ..... 215/49
5,129,566 A 7/1992 Ogden
5,423,440 A * 6/1995 Castaneda et al. ..... 215/49
6,244,487 B1 * 6/2001 Murray ..... 225/93
6,540,125 B1 4/2003 De Jongh
6,712,252 B2 * 3/2004 Starr ..... 225/1
6,832,703 B1 * 12/2004 Scott et al. ..... 222/189.06
D527,456 S * 8/2006 de Vries ..... D24/133
7,621,411 B2 * 11/2009 Doherty et al. ..... 215/228
8,132,959 B2 * 3/2012 Smit ..... 366/182.3

FOREIGN PATENT DOCUMENTS

DE 6911014 7/1969
GB 2081692 2/1982
GB 2352233 1/2001
WO 2007042828 A2 4/2007

* cited by examiner

*Primary Examiner* — Omar Flores Sanchez
(74) *Attorney, Agent, or Firm* — Ann M. Knab; Thad McMurray

(57) ABSTRACT

The invention relates to an ampule breaking aid for a glass ampule having a predetermined breaking point between a head portion and a use portion, said ampule breaking aid having a base body that receives the use portion, and a cap that overlaps the head portion, wherein the cap is supported on the base body, in particular is supported in an unconnected manner and wherein the cap and the base body, especially at the front surfaces; thereof facing one another form a pivot bearing having an axis of rotation that substantially passes through the predetermined breaking point.

18 Claims, 3 Drawing Sheets

AMPULE BREAKING AID

CROSS-REFERENCE TO RELATED APPLICATIONS

This application claims foreign priority benefits under 35 U.S.C. §119(a)-(d) from European patent application ser. no. 09 161 599.7 filed May 29, 2009.

TECHNICAL FIELD

The invention relates to an ampule breaking aid for breaking a glass ampule having a predetermined breaking point between a head portion and a use portion.

BACKGROUND OF THE INVENTION

Ampules made from glass that completely surrounds the liquid, have been tested and proved successfully for the safe storage of liquids in order to prevent the liquid from being contaminated. In contrast to a bottle, ampules of this kind do not possess a cover or lid or some other closure. In order to open the ampule the upper part thereof, the so-called head portion, is quickly broken away, and the useful liquid is then available in the lower part of the ampule, the so-called use portion. Ampules of this kind may provide the required liquid in the requested amount in a cost-efficient manner, for example in the pharmaceutical field, but in particular for dental applications.

Breaking away the head portion is advantageously effected via a predetermined breaking point such as a lateral contraction or neck at the ampule. Breaking the ampule is typically effected by the dentist or physician manually bending the ampule at the respective position. The use portion of the ampule per se, however, may not be set upright or deposited so that the physician or dentist in the case of a partial consumption of the liquid quickly puts the use portion on a mat, in the hope that no liquid leaks due to the cohesion of the liquid and the reduced diameter outlet at the neck of the predetermined breaking point.

Some physicians and dentists are of the opinion that the manual breaking of the glass ampule is a risk and fear that they get hurt if the ampule breaks at an unintended position. In practice, the fact is somewhat more relevant that for the most part there exists a sharp-edged glass bezel at the predetermined breaking point that involves a certain risk of getting injured.

In order to reduce the risks and to improve the handling, ampule holders have become known that serve as a protection for the ampule. A solution of this kind for example can be taken from U.S. Pat. No. 5,129,566. With this solution, an asymmetric reception of the ampule within the ampule breaking aid is provided. The ampule breaking aid entirely surrounds the ampule. Basically, it is formed in two pieces and is comprised of a base body for receiving the use portion and a cap for receiving the head portion. The cap is formed asymmetrically relative to the head portion, and for its introduction the ampule must be pressed into a specific position so that the predetermined breaking point substantially corresponds to the parting line between the cap and the base body.

This solution, indeed, is well suitable for protecting the ampule. With this solution, however, it is disadvantageous that in practice a break at a wrong position, which is not at the predetermined breaking point, cannot be excluded. This even can result in glass particles spalling off and in that case getting into the liquid, or contributing otherwise to injuries.

This is particularly undesirable and also dangerous as especially with ampules received within ampule holders it is easily overlooked that a small piece of glass is missing. The dentist or doctor also does not have the possibility to determine whether a glass particle has been lost by holding the head portion next to the use portion as the ampule holder or ampule breaking aid completely or nearly completely covers the glass ampule.

Moreover, numerous other embodiments of ampule holders and ampule protection devices have become known. By way of example, reference is made to U.S. Pat. No. 2,865,524 and U.S. Pat. No. 6,540,125 in this connection. These solutions are quite strongly dependent on the skill of the operating doctor or dentist.

On the other hand, the invention is based on the object of providing an ampule breaking aid according to the preamble of claim 1 that may be handled in a more reliable manner, that may be manufactured in a well-priced manner and that is ergonomically improved.

OBJECTS AND SUMMARY OF THE INVENTION

According to the invention it is provided to provide the ampule breaking aid with a defined pivot bearing that ensures safe guiding of the head portion and the use portion. By exactly defining the height of the glass ampule relative to the ampule breaking aid, it is therefore assured that the folding effect is always active at the same position, that is to say at the predetermined breaking point of the ampule, so that a breakage with a spalling effect is excluded almost certainly.

According to the invention it is particularly favorable that with the aid of the axis of rotation the pivot bearing may realize a well-directed and guided rolling-off of head portion and use portion on or at one another, respectively. This permits to convert the abrupt breaking motion that requires to overcome a resistance, into a guided motion and in this respect into a motion that runs in a defined manner, whereas it is ensured at the same time that neither the open or raw cutting edges of the cap nor those of the base body protrude after they have been separated from each other.

This may for example be realized by forming portions corresponding to the pivot bearing, wherein one portion at its front end thereof facing the other portion, is formed in the manner of a joint socket, and the other portion is formed in the manner of a joint head. The axis of rotation always runs transversely through the ampule and through the predetermined breaking point. The result is that a part of the use portion and a part of the head portion in the direction of the longitudinal axis of the ampule protrude in the direction towards the other portion, respectively, as those portions in this respect engage with one another.

This causes the cutting edges and cutting points each returning or being recessed relative to the foremost points of the portions so that a protected reception of the cutting edges is realized in this manner on the opposite side.

This is possible with surprisingly easy means; the use portion and the head portion may each be manufactured from a well-priced plastic material that additionally also enables a certain damping function for vibrations so that the ampule consisting of glass is better protected.

An advantageous embodiment enables to define the height of the ampule relative to the ampule breaking aid by means of protrusions that ensure that the axis of rotation exactly passes through the predetermined breaking point. It is preferred to provide an embodiment that is substantially circlesymmetric or comprises fins that extend circularly so that an inwardly uniform support of the ampule takes place.

Preferably, some kind of pullout locking device or protection is additionally provided for preventing the glass ampule in its base body from being pulled out from the use portion. This may be realized with the aid of a resilient latch or catching recess that prevents the use portion from inadvertently leaving the base body after breakage of the predetermined breaking point.

On the other hand, it is particularly favorable if the base body on its own is stable and at its base or surface area for example comprises a ratio of at most 1:2 relative to the height of the base body. The structural safety or stability is thus especially well provided whereas it is also possible to provide small bases or stands that straddle away outwardly or to attach a protruding bead in order to realize the desired stability or structural safety in a material-saving manner.

According to the invention it is particularly favorable that the pivot bearing is formed by matching arcuate portions at the face ends of the cap and the base body, whereby the convex arcuate or curved portion especially is formed at the base body.

According to the invention it is particularly favorable that the cap and the base body have support areas at the front surfaces thereof facing one another that limit the rotary motion of the pivot bearing and that the pivoting mobility of the bearing in particular is limited to less than +/−30°, preferably less than +/−20° and especially preferably approximately to +/−10°.

According to the invention it is particularly favorable that the base body and/or the cap are/is formed of a more flexible and in particular also softer material than the glass ampule, in particular are/is formed of a flexibly preset plastic material.

According to the invention it is particularly favorable that the base body comprises a footprint or platform with the aid of which the glass ampule that is received within the ampule breaking aid, has a safe position or stand even in the case of a broken-away head portion, and that the base body tapers towards the direction of the pivot bearing, in particular starting from the footprint.

According to the invention it is particularly favorable that the footprint or platform comprises an outward-facing protrusion, in particular a circumferential bead.

According to the invention it is particularly favorable that the head portion and the use portion at the pivot bearing comprise inner contours and outer contours matching one another.

According to the invention it is particularly favorable that the base body and/or the cap comprise flares at the front surfaces thereof facing one another, said flares serving to support the base body and the cap relative to one another transversely to the direction of the axis of rotation of the pivot bearing.

According to the invention it is particularly favorable that the use portion is supported in the base body on the bottom and on the side thereof substantially free of play and is retained therein by means of frictional locking, such that the use portion remains within the base body in case a liquid received within the use portion is discharged or poured out.

According to the invention it is particularly favorable that the base body comprises a filling level indication, in particular a vertical viewing slot that indicates the liquid level of the use liquid retained or stored in the use portion.

According to the invention it is particularly favorable that the head portion is received within the cap in particular in a friction-locked manner, and that the cap comprises a particularly tapered inner contour.

According to the invention it is particularly favorable that the cap comprises at least one radially inward-facing protrusion for supporting the head portion.

According to the invention it is particularly favorable that the base body and the cap completely surround the glass ampule, if applicable leaving some windows.

According to the invention it is particularly favorable that the base body and the cap are formed in two pieces, and that in the broken condition of the glass ampule, both the use portion in the base body and the head portion in the cap are each received therein in a recessed or buried manner, such that the predetermined breaking point of the glass ampule is substantially arranged in a recessed or buried manner relative to the front surfaces of the cap and the base body, respectively.

According to the invention it is particularly favorable that a protrusion pointing from the ampule breaking aid to the glass ampule is provided, said protrusion supporting the glass ampule and determining the relative height of the ampule in the ampule breaking aid.

BRIEF DESCRIPTION OF THE FIGURES

Further advantages, details and features emerge from the following description of several exemplary embodiments with reference to the drawings, in which.

DETAILED DESCRIPTION

Figure 1:
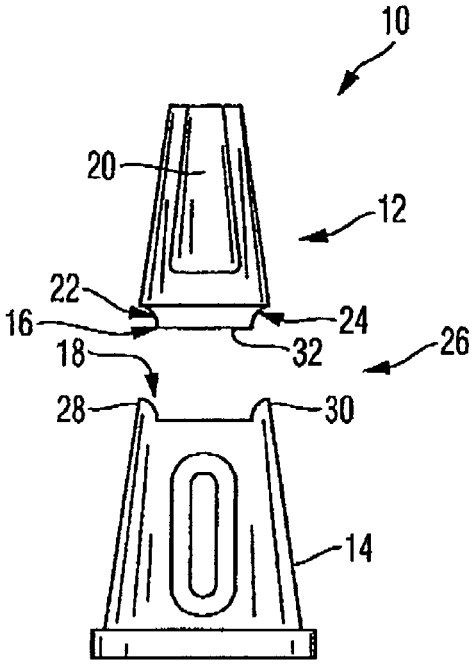
FIG. 1 represents a schematic lateral view of an embodiment of an ampule breaking aid according to the invention.

The ampule breaking aid 10 according to FIG. 1 comprises a cap 12 and a base body 14 that at the end surfaces 16 and 18 thereof are embodied in a manner that matches one another.

The cap 12 comprises a basic design that tapers bottom-up. This also applies to the base body 14 whose upper front surface substantially has the same diameter as the lower front surface 18 of the cap 12. The cap 12 is fabricated of a single material.

The cap 12 comprises a recessed grip 20 intended to facilitate the manipulation or guiding of the hand when breaking the ampule. In the representation according to FIG. 1, at the rear side of the cap, joint sockets 22 and 24 of a pivot bearing 26 are formed on the right and on the left that interact with corresponding joint heads 28 and 30 on the top side of the base body 14.

Moreover, flares 32 and 34 of the cap 12 extend downwardly beyond the pivot bearing 26 on the side thereof, said flares at the same time serving to guide the two parts of the ampule breaking aid relative to one another and that enable a support thereof.

Figure 2:
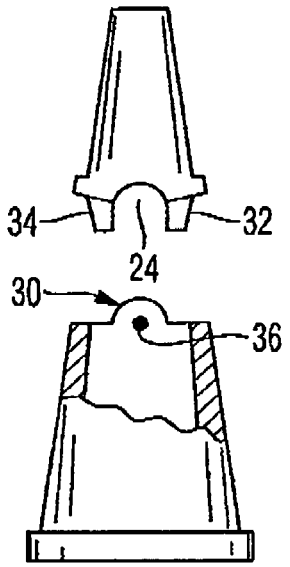
FIG. 2 represents a lateral view of the embodiment according to FIG. 1, partially broken away, however, represented from a different viewing direction.

FIG. 2 shows that the joint socket 24 and also the joint head 30 are substantially formed in a semi-circular manner. In this way, an axis of rotation 36 is formed for the pivot bearing, and the pivot movement of the cap 12 relative to the base body 14 may be restricted with the aid of stops 16 and 18 in the desired manner.

Figure 3:
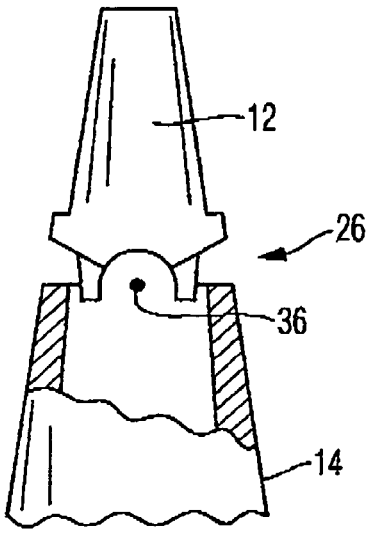
FIG. 3 shows an enlarged representation of the pivot bearing in the embodiment according to FIG. 1.
Figure 4:
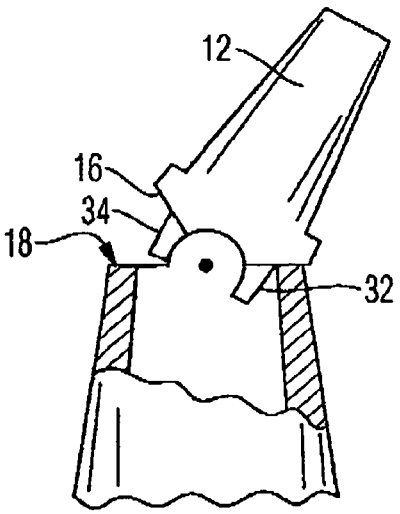
FIG. 4 shows a further representation of the pivot bearing according to FIG. 3, however in a different pivot position.

This becomes apparent in FIGS. 3 and 4 that show the pivot bearing 26 in an enlarged representation. As it is apparent, the front face 16 forms a support on the front face 18 in the area of the flare 32 so that the pivot movement of the cap 12 relative to the base body 14 is limited to approximately 30 degrees with respect to the vertical.

Figure 5:
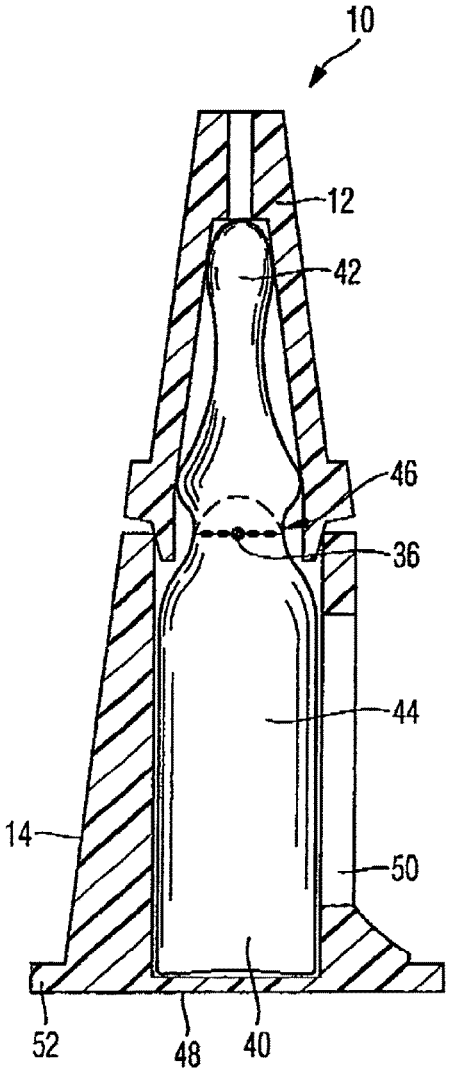
FIG. 5 represents a sectional view of an inventive ampule breaking aid, also showing the ampule.

FIG. 5 illustrates a modified design of the ampule breaking aid 10, also showing the reception of the glass ampule 40 in the ampule breaking aid 10. The glass ampule 40 comprises a head portion 42 and a use portion 44 that are connected integrally to one another. The connection is effected via a predetermined breaking point 46 that is formed in a manner known per se by a constriction or neck which may be slightly slit per se for example. A glass ampule 40 that is kinked without an ampule breaking aid, typically exactly breaks at the predetermined breaking point and thus leaves behind two separate parts, that is to say the head portion 42 and the use portion 44.

The exact design of the glass ampule 40 may be adapted to the requirements to a large extent. However, it is preferred that the use portion 44 is substantially larger than the head portion, for example comprises 3 to 50 times the volume thereof.

The head portion 42 is safely guided within the cap 12 and the use portion 44 is safely guided within the base body 40. In this respect, the inner surface of the respective parts of the ampule breaking aid 10 is adapted to the outer surface of the two portions 42 and 44, respectively. In this way, the height of the portions relative to the ampule breaking aid is defined as well, so that the predetermined breaking point 46 is exactly located on the axis of rotation 36 which moreover is schematically indicated in FIG. 5.

The base body 14 also comprises a protrusion 48 that allows the determination in height for the use portion 44 and thus for the glass ampule 40. The filling or loading of the ampule breaking aid 10 with the glass ampule is effected in a manner that in case of the cap 12 being removed, the ampule 40 is quickly pressed into the base body 14 until it contacts the protrusion 48, which may be in the form of a shim or shims, and then the head portion 12 is put on or fitted so that it overlaps the head portion 42.

The use portion 44 is safely received within the base body 14 in a force-fit manner or with the aid of a catch or locking device (not shown). The same applies for the reception of the head portion 42 within the cap 12.

As is also apparent from FIG. 5, a viewing slot 50 is formed on the side of the base body 14 that enables to determine the filling level of the use portion 44 from outside. Moreover, the base body 14 at its closed bottom side comprises an enlarged footprint or contact surface 52 that serves to ensure that the use portion 44 that is filled with the liquid, does not inadvertently tilt over. In this connection, the inventive ampule breaking aid 10 also inures to the benefit of the total conical design of the two parts of the ampule breaking aid 10.

Figure 6:
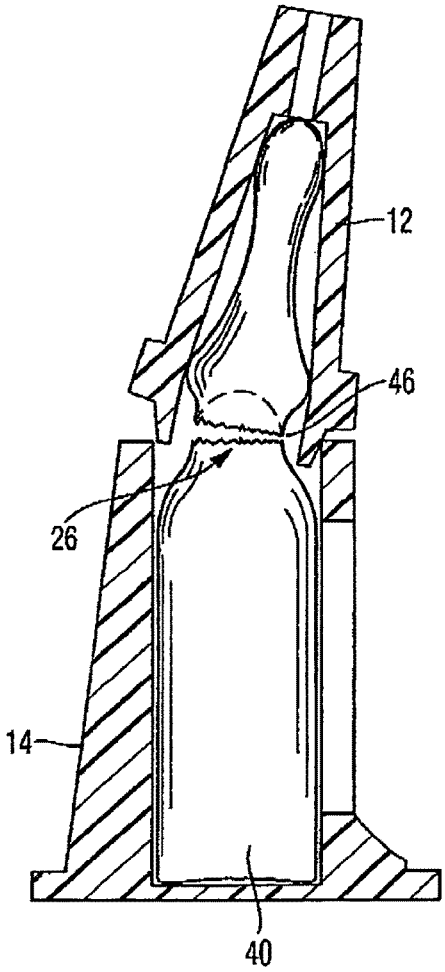
FIG. 6 is a representation according to FIG. 5, with a broken ampule.

FIG. 6 illustrates in which manner a breakage of the ampule 40 at the predetermined breaking point 46 is effected. By laterally bending or kinking the cap 12 relative to the base body 14, the ampule 40 breaks at the predetermined breaking point 46, whereas at the same time the cap 12 rolls off the pivot bearing 26 relative to the base body 14.

Figure 7:
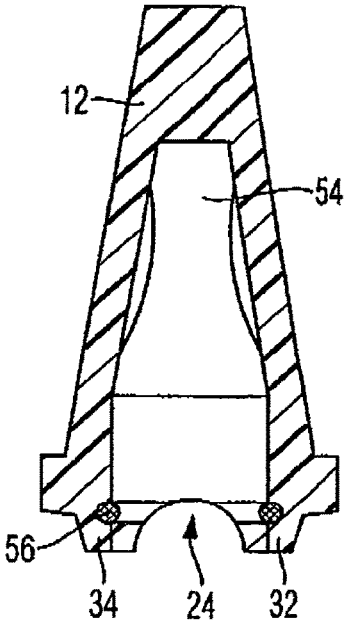
FIG. 7 is a modified embodiment of the cap for an ampule breaking aid according to FIGS. 5 and 6.

From FIG. 7 it is apparent, in which manner the head portion 42 (compare FIG. 5) may be retained within the cap 12 by means of flexible or elastic protrusions 54. Additionally, an inserted sealing ring or O-ring 56 may be provided that also offers an elastic support of the head portion and thus the glass ampule 40.

Figure 8:
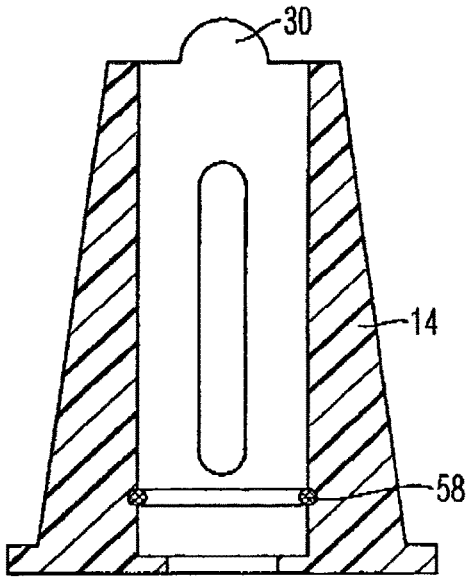
FIG. 8 is a modified representation of a base body for an ampule breaking aid according to FIGS. 5 and 6.

FIG. 8 illustrates that a similar sealing ring 58 may also be realized in the lower area of the base body 14. With the aid of a sealing ring of this kind that for example may be comprised of plastic material or rubber, an elastic frictional connection is produced that reliably prevents the glass ampule 40 from slipping out of the ampule breaking aid at the two portions thereof, respectively.

Figure 9:
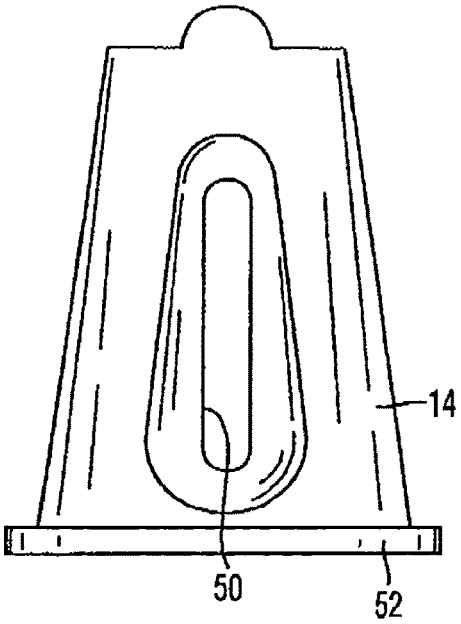
FIG. 9 is a lateral view of the base body according to FIG. 8.

From FIG. 9 it is apparent that the viewing slot 50 may nearly extend over the entire height of the base body 14. The footprint or contact surface 52 has a width that almost corresponds to the height of the base body 14.

Figure 10:
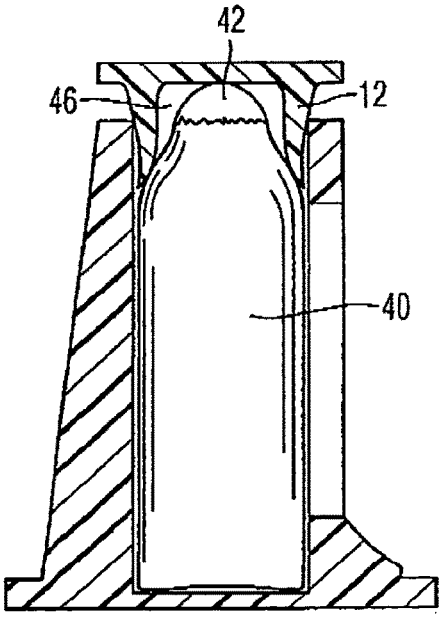
FIG. 10 shows the use of a base body according to FIGS. 8 and 9 for a modified embodiment of an ampule breaking aid.

FIG. 10 illustrates in which manner an ampule 40 having a substantially smaller head portion 42 may be accommodated according to the invention. The cap 12 as well is considerably minimized in this exemplary embodiment and the predetermined breaking point is located just below the top end of the glass ampule 40.

The ampule breaking aid may also be referred to as ampule protection.

While preferred forms of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the terms as used in the claims are intended to include not only the designs illustrated in the drawings of this application and the equivalent designs discussed in the text, but are also intended to cover other equivalents now known to those skilled in the art, or those equivalents which may become known to those skilled in the art in the future.

What is claimed is:

1. A glass ampule and an ampule breaking aid system comprising:

the glass ampule having a predetermined breaking point between a head portion and a use portion, the ampule breaking aid having a base body (14) that receives the use portion, and a cap (12) that overlaps the head portion, wherein the cap (12) is supported on the base body (14) in an unconnected manner and is pivot-mounted so that the predetermined breaking point of the glass ampule may be broken if the cap (12) is pivoted relative to the base body (14), wherein the use portion and the head portion are integrally formed, wherein the cap is fabricated of a single material, and wherein the base body (14) comprises a closed bottom footprint or platform with the aid of which the glass ampule (40) that is received within the ampule breaking aid (10), has a safe position or stand even in the case of a broken-away head portion (42).

2. The ampule breaking aid as claimed in claim 1, wherein the cap (12) and the base body (14) comprise support surfaces at front surfaces (16, 18) thereof facing one another, said support surfaces limiting the rotary motion or rotation of the pivot bearing (26), and wherein the pivot movement of the bearing is limited to less than +/−30°.

3. The ampule breaking aid as claimed in claim 1, wherein the base body (14) and/or the cap (12) comprise flares (32, 34) at front surfaces (16, 18) thereof facing one another, said flares (32, 34) serving to support the base body (14) and the cap (12) relative to one another transversely to the direction of the axis of rotation (36) of the pivot bearing (26).

4. The ampule breaking aid as claimed in claim 1, wherein the cap (12) and the base body (14) are provided with a pivot bearing (26) rotatable about an axis of rotation (36) that substantially passes through the predetermined breaking point (46) of the glass ampule (40), said pivot bearing (26) being formed by curved sockets (22, 24) on the cap and matching projections (32, 34) on the base body; and wherein the cap (12) and the base body (14) are provided with matching end surfaces (16, 18) facing one another which may act as stops when the parts are pivoted relative to each other.

5. The ampule breaking aid as claimed in claim 1, wherein the base body (14) and/or the cap (12) are comprised of a flexibly preset plastic material which is more flexible and/or softer than the glass ampule (40).

6. The ampule breaking aid as claimed in claim 1, wherein the base body (14) tapers towards the direction of the pivot bearing (26) starting from the footprint.

7. The ampule breaking aid as claimed in claim 6, wherein the footprint or platform comprises an outward-facing protrusion (52).

8. The ampule breaking aid as claimed in claim 1, wherein the use portion (44) is supported in the base body (14) on the bottom and on the side thereof substantially free of play and is retained therein by means of frictional locking, such that the use portion (44) remains within the base body (14) in case a liquid received within the use portion (44) is discharged or poured out.

9. The ampule breaking aid as claimed in claim 1, wherein the base body (14) comprises a filling level indication in the form of a vertical viewing slot (50) that indicates the liquid level of the use liquid retained or stored in the use portion (44).

10. The ampule breaking aid as claimed in claim 1, wherein the head portion (42) is received within the cap (12) in a friction-locked manner, and wherein the cap (12) comprises a particularly tapered inner contour.

11. The ampule breaking aid as claimed in claim 10, wherein the cap (12) comprises at least one radially inward-facing protrusion (54) for supporting the head portion (42).

12. The ampule breaking aid as claimed in claim 1, wherein the base body (14) and the cap (12) completely surround the glass ampule (40), leaving some windows.

13. The ampule breaking aid as claimed in claim 1, wherein the base body (14) and the cap (12) are formed in two pieces, and wherein in the broken condition of the glass ampule (40), both the use portion (44) in the base body (14) and the head portion (42) in the cap (12) are each received in a recessed or buried manner, so that the predetermined breaking point (46) of the glass ampule (40) is substantially arranged in a recessed or buried manner relative to the front surfaces (16, 18) of the cap (12) and the base body (14).

14. The ampule breaking aid as claimed in claim 1, wherein a protrusion (48) pointing from the ampule breaking aid (10) to the glass ampule (40) is provided, said protrusion (48) supporting the glass ampule (40) and determining the relative height of the ampule in the ampule breaking aid (10).

15. The ampule breaking aid as claimed in claim 1, wherein the cap and the base body are each provided with an elastic frictional connection to provide support for the head and use portions of the glass ampule.

16. The ampule breaking aid as claimed in claim 15, wherein the elastic frictional connection is an O-ring.

17. The ampule breaking aid as claimed in claim 1, wherein the base body is provided with a protrusion (48) that allows the determination in height for the use portion (44) and thus for the glass ampule (40).

18. The ampule breaking aid as claimed in claim 4, wherein the pivot bearing (26) comprises an axis of rotation (36) that substantially passes through the predetermined breaking point (46) of the glass ampule.

* * * * *